US008813969B2

(12) United States Patent
Furtenbach

(10) Patent No.: US 8,813,969 B2
(45) Date of Patent: Aug. 26, 2014

(54) SPIRAL MODULE FOR A TROMMEL SCREEN

(75) Inventor: Lars Furtenbach, Skellefteå (SE)

(73) Assignee: Metso Minerals (Wear Protection) AB, Ersmark (SE)

( * ) Notice: Subject to any disclaimer, the term of this patent is extended or adjusted under 35 U.S.C. 154(b) by 499 days.

(21) Appl. No.: 12/451,493

(22) PCT Filed: Apr. 25, 2008

(86) PCT No.: PCT/SE2008/050472

§ 371 (c)(1),
(2), (4) Date: Nov. 16, 2009

(87) PCT Pub. No.: WO2008/140394

PCT Pub. Date: Nov. 20, 2008

(65) Prior Publication Data

US 2010/0122941 A1 May 20, 2010

(30) Foreign Application Priority Data

May 16, 2007 (SE) ..... 0701186

(51) Int. Cl.
*B07B 1/49* (2006.01)
*B07B 1/24* (2006.01)
*B07B 1/46* (2006.01)

(52) U.S. Cl.
CPC ..... *B07B 1/24* (2013.01); *B07B 1/4645* (2013.01)
USPC ..... 209/405

(58) Field of Classification Search
USPC ..... 209/405
IPC ..... F16D 48/066; B07B 1/24
See application file for complete search history.

(56) References Cited

U.S. PATENT DOCUMENTS 299,337 A * 5/1884 Brotherhood ..... 209/452
629,465 A * 7/1899 Phillips ..... 184/86

(Continued)

FOREIGN PATENT DOCUMENTS

DE 196 26 741 1/1998
DE 202 14 115 3/2004

(Continued)

*Primary Examiner* — Stefanos Karmis
*Assistant Examiner* — Michael E Butler
(74) *Attorney, Agent, or Firm* — Andrus Intellectual Property Law, LLP

(57) ABSTRACT

The invention concerns a spiral module (1) for a trommel screen comprising a flat part (5) that transports ore and that is designed as a product that becomes worn, with an elastic cladding (27) that functions as wear lining, intended to interact with the charge for the transport of the charge forwards on a sieving deck (2) that is a component of the sieving drum, mounting fixtures (9, 9') intended for coupling with hole openings (3) in the sieving deck and supporting the part that transports ore directed in towards the central axis of the sieving drum. In order to achieve increased flexibility and exchangeability, it comprises first attachment means (10) with which each mounting fixture (9, 9') is connected in a manner that allows it to be removed with the part (5) that transports ore, and can be adjusted into different angular positions relative to the longitudinal axis of the part (5) that transports ore through rotation around an axis (C) of rotation defined by the first attachment means (10), second attachment means (20) one each of which is supported by a relevant mounting fixture (9, 9') that can be removed, allowing the mounting fixture to be connected with a hole opening (3) in the sieving deck.

12 Claims, 5 Drawing Sheets

(56) References Cited

U.S. PATENT DOCUMENTS

| | | | | | |
|---|---|---|---|---|---|
| 1,405,914 | A | * | 2/1922 | Hamachek | 460/142 |
| 1,675,572 | A | * | 7/1928 | Morse | 209/266 |
| 2,450,980 | A | * | 10/1948 | Moyer | 209/452 |
| 2,599,402 | A | * | 6/1952 | Lindsey | 209/44 |
| 2,728,940 | A | * | 1/1956 | Yesberger et al. | 264/117 |
| 2,882,976 | A | * | 4/1959 | Wheeler et al. | 171/128 |
| 3,078,050 | A | * | 2/1963 | Hardinge | 241/24.1 |
| 3,083,389 | A | * | 4/1963 | Wittek | 15/97.1 |
| 3,316,585 | A | * | 5/1967 | Kallberg | 425/182 |
| 3,341,877 | A | * | 9/1967 | Ingalls | 15/3.11 |
| 3,659,440 | A | * | 5/1972 | Lyon | 69/30 |
| 3,670,534 | A | * | 6/1972 | Gould | 69/30 |
| 3,988,114 | A | * | 10/1976 | Gorin et al. | 23/313 R |
| 4,113,413 | A | * | 9/1978 | Pietrusza et al. | 425/222 |
| 4,132,749 | A | * | 1/1979 | Saito et al. | 525/84 |
| 4,159,242 | A | * | 6/1979 | Walker | 209/44 |
| 4,203,831 | A | * | 5/1980 | Parnaby | 209/13 |
| 4,265,408 | A | | 5/1981 | Voelskow | |
| 4,312,749 | A | | 1/1982 | Bingham | |
| 4,323,449 | A | * | 4/1982 | Pelletier | 209/17 |
| 4,563,268 | A | | 1/1986 | Smith | |
| 5,062,601 | A | * | 11/1991 | Graf | 241/79.3 |
| 5,346,071 | A | * | 9/1994 | Page et al. | 209/257 |
| 5,417,858 | A | * | 5/1995 | Derrick et al. | 210/388 |
| 5,427,250 | A | * | 6/1995 | Page et al. | 209/284 |
| 5,534,437 | A | * | 7/1996 | Arrau | 435/290.3 |
| 5,779,527 | A | * | 7/1998 | Maebashi | 451/328 |
| 5,988,348 | A | * | 11/1999 | Martin et al. | 194/317 |
| 6,458,240 | B1 | * | 10/2002 | Bouchette et al. | 162/4 |
| 2013/0181077 | A1 | * | 7/2013 | Harris et al. | 241/38 |

FOREIGN PATENT DOCUMENTS

| | | |
|---|---|---|
| FR | 2559687 | 8/1985 |
| GB | 653219 | 5/1951 |
| GB | 2 047 575 | 12/1980 |

* cited by examiner

SPIRAL MODULE FOR A TROMMEL SCREEN

This application is the U.S. national phase of International Application No. PCT/SE2008/050472 filed 25 Apr. 2008 which designated the U.S. and claims priority to Swedish Patent Application No. 0701186-9 filed 16 May 2007, the entire contents of each of which are hereby incorporated by reference.

The present invention concerns a spiral module for a trommel screen according to the introduction to claim 1.

Spiral modules are used within the mining industry in trommel screens for the sorting of ore that has been ground down into finely divided fractions in previous process steps. The said spiral modules are designed as exchangeable units intended to be mounted one after the other to give a spiral form perpendicular to the inner surface of the ring-shaped sieving deck of the trommel screen, which deck consists of sieving plates provided with holes mounted into a rotating holder. Identical fins protrude in towards the centre of the drum from the spiral modules that are mounted one after the other, which fins together form a spiral, or screw-shaped, guide that passes along the inner surface of the sieving deck and whose task is to feed the ore, also known as the "charge", forwards through the drum.

One known spiral module is manufactured as a disposable rubber product formed as a single piece comprising a stiff inner reinforcing frame or support of metal that has the form of an extended plate-shaped part that transports ore, and two cross-pieces fixed attached to one long edge of the plate-shaped part by welding. The said cross-pieces are normally located in connection with the ends of the plate-shaped part and form a part of a mounting fitting that is a component of the spiral module and that serves as a foot or support, intended for attachment of the spiral module to the sieving deck. The inner continuous reinforcement frame of the spiral module is provided with protection from wear in the form of a cladding of an elastic or rubber material such as, for example, natural or synthetic rubber. The spiral module is mounted standing on the mounting fitting onto the sieving deck with the part that transports the ore directed perpendicularly in towards the centre of the drum. The mounting fitting comprises holes for the reception of screws that pass through the holes of the sieving deck and that are secured by means of nuts.

One of the major advantages of designing the spiral modules as exchangeable smaller units is that individual spiral modules can be exchanged when they have become worn to a greater extent than other elements and that they can be adjusted in order to change the angle of ascent of the spiral. One disadvantage of known spiral modules is that they normally must be specially manufactured in order to fit against the sieving deck of a particular drum, and they cannot be used in a flexible manner with drums of differing types. Such drums of different types are for example, drums with different diameters, and drums with sieving decks with at least one of different patterns of holes and different sizes of the sieving holes. It is normally difficult to find suitable mounting holes in the sieving deck when mounting the individual spiral modules, particularly if the spiral modules are furthermore to be oriented at a certain given angle to the central axis of the drum.

Since spiral modules are mounted in a sideways direction relative to the main surface of the sieving deck, the surface that transports ore, they are subject to particularly severe wear. Individual spiral elements must for this reason be exchanged once or several times during the lifetime of the sieving deck that is formed by the sieving elements. As has been mentioned above, exchange of individual sieving elements takes place as a result not only of wear but also as a result of other causes such as, for example, variation of the angle of feed of the continuous spiral towards the central axis of the drum, and when exchanging an existing sieving deck for a deck that has a different size of hole, and thus a different pattern of holes.

The purpose of the present invention is thus to achieve a spiral module that not only makes mounting easier but also makes it possible to renovate and exchange individual fixtures of each individual spiral module. A second purpose of the invention is to achieve a spiral module that is easy to adjust and to reset for the formation of continuous spirals with different angles of ascent.

These purposes of the invention are achieved through a spiral module that demonstrates the features and characteristics that are specified in claim 1. Other advantages and features of the invention are made clear by the non-independent claims.

The invention will be described in more detail below with the guidance of an embodiment with reference to the attached drawings, of which:

Figure 1:
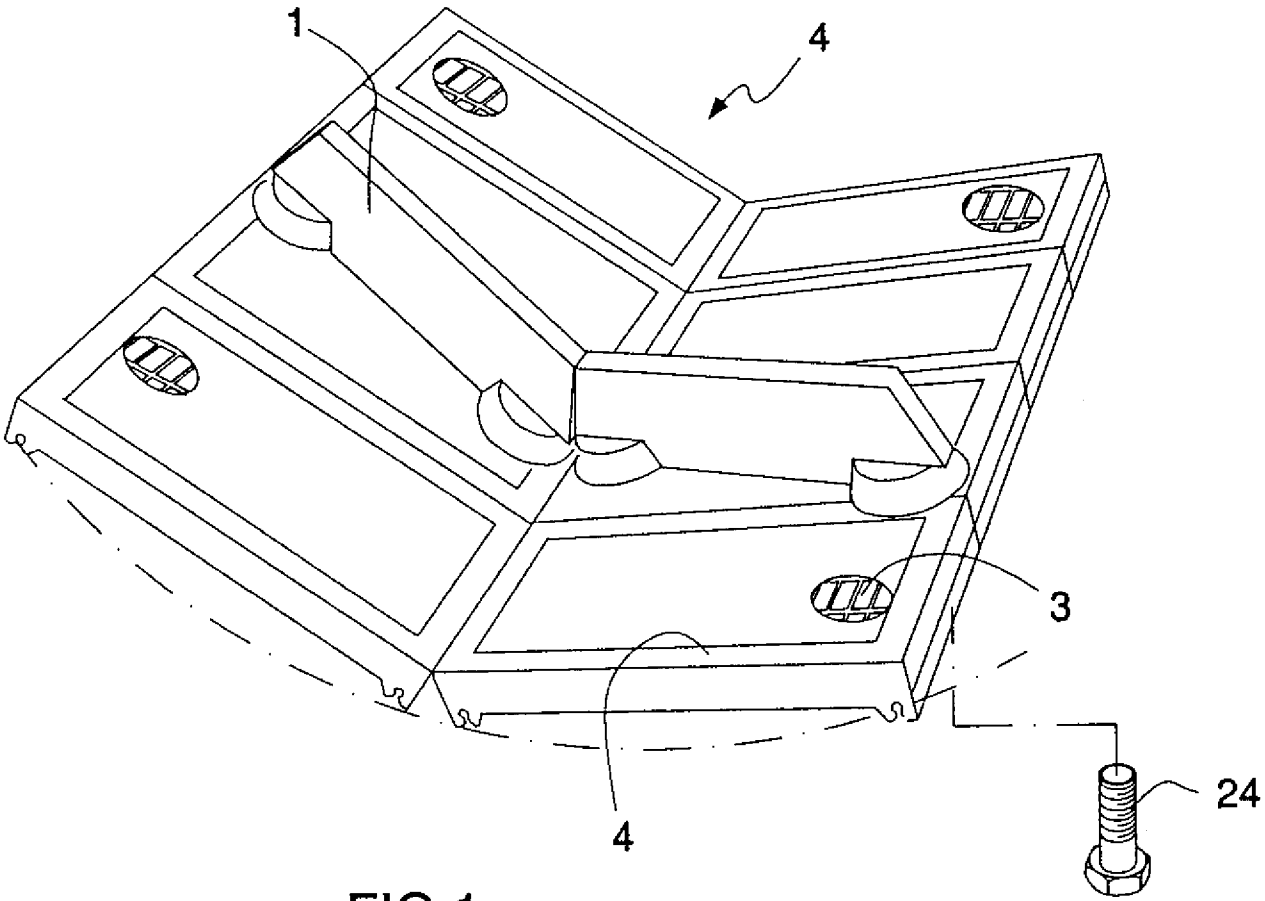
FIG. 1 shows a perspective view obliquely from above of a section of a sieving deck according to the present invention with two spiral modules mounted one after the other

As is shown in FIG. 1, the invention relates to spiral modules 1 intended to be mounted one after the other to give a spiral form perpendicular to the inner surface of a ring-shaped sieving deck 2 that is a component of a drum and that has the form of an arc of a circle or is concave. The said sieving deck normally consists of rubber-clad plates 4 that are mounted in a surrounding rigid framework and that have sieving openings 3. Identical fins protrude from the spiral modules 1 that are mounted against the sieving deck 2 inwards towards the centre of the drum and form together in a substantially end to end relationship a continuous spiral or screw-formed guide that runs along the inner surface of the sieving deck and whose task is to transport the charge forwards through the drum.

Figure 2:
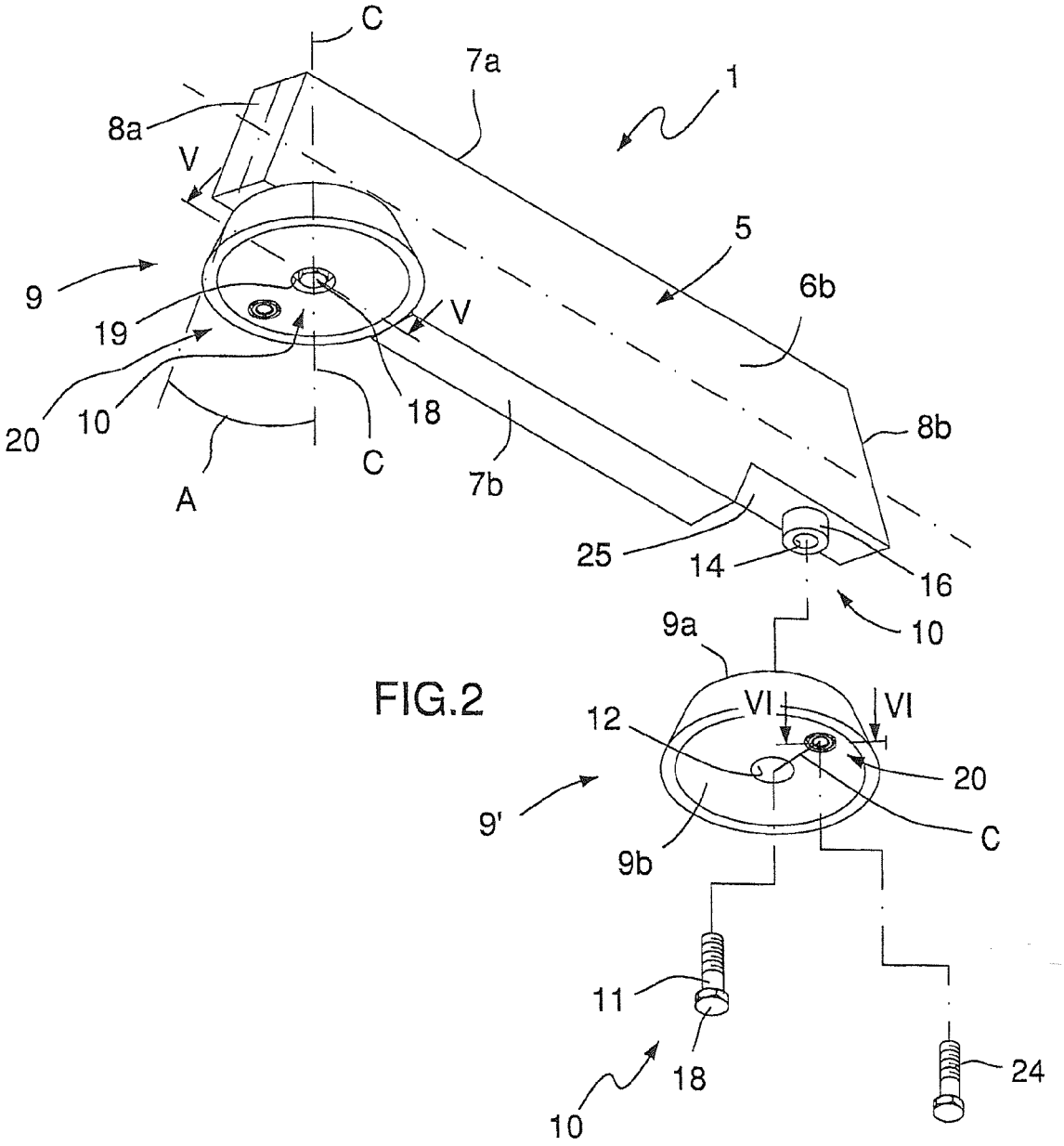
FIG. 2 shows a perspective view obliquely from below of a spiral module with parts that have been partially separated from each other

The spiral module 1 is shown in more detail in FIG. 2 and this drawing makes clear that the spiral module comprises not only an extended part 5 that transports the ore forwards and that has essentially the form of an extended plate that demonstrates two plane-parallel principal surfaces 6*a*, 6*b* that face away from each other, two long edges 7*a* and 7*b* that are also plane-parallel and face away from each other, and two short edges 8*a* and 8*b* that also are plane-parallel and face away from each other;

but also two mounting fittings 9, 9' each of which has the form of a truncated circular cone with an upper surface 9*a* and a bottom surface 9*b* that are plane-parallel to each other. The said mounting fittings 9, 9' are located at opposite bottom ends of the part 5, and form feet that support the spiral module on the sieving deck 2. The long edge 7*a* that faces the centre of the drum is called the "upper long edge" while the long edge 7*b* that faces the sieving deck 2 when the spiral module has been mounted is called the "lower long edge".

Figure 3:
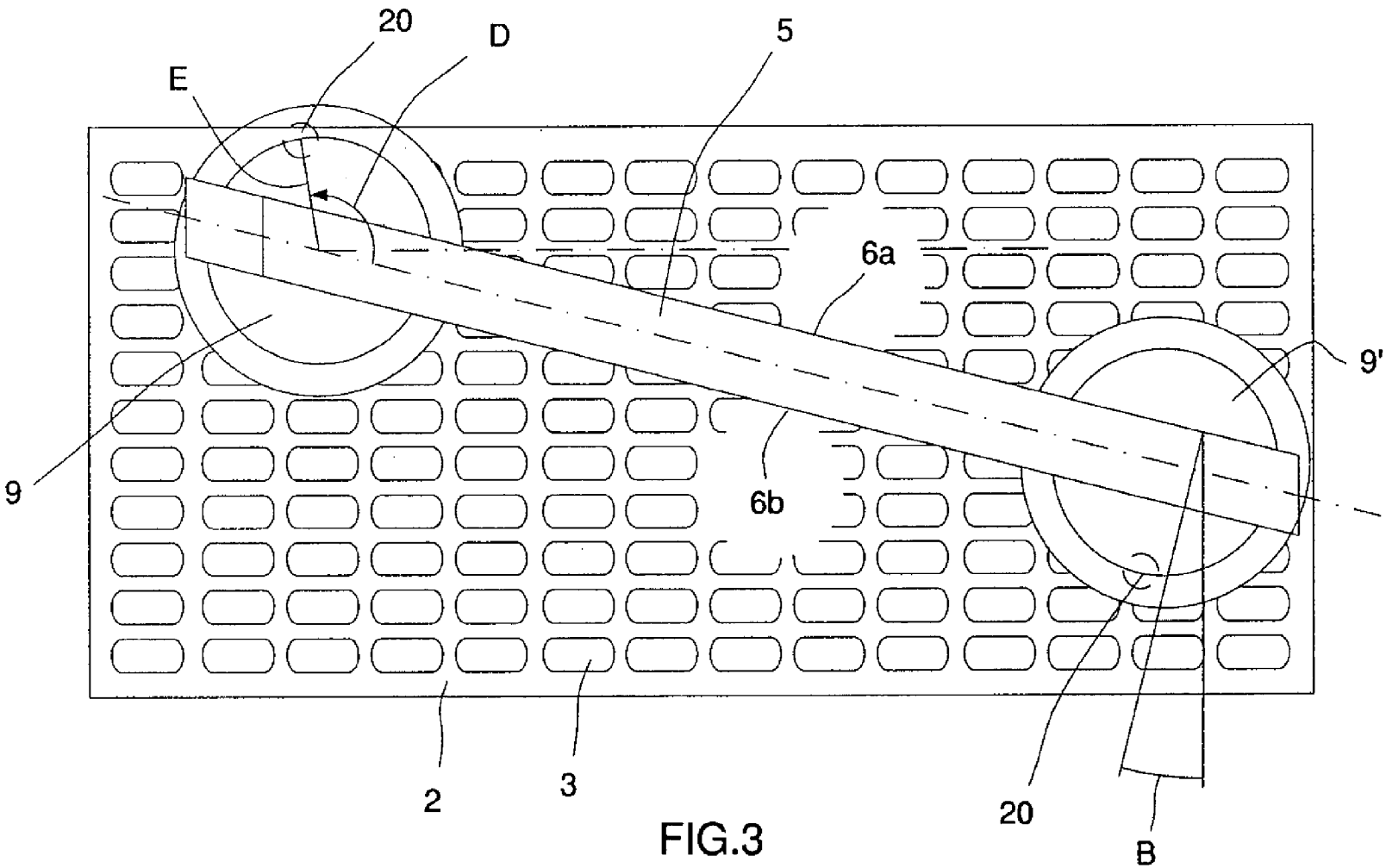
FIG. 3 shows a view from above of the spiral module according to FIG. 2

As FIGS. 2 and 3 make clear, the two short edges 8*a* and 8*b* that face away from each other are arranged as tilted planes with double angles A and B, respectively, which have been selected such that the spiral modules 1 can be mounted one after the other onto the concave inner surface of the drum in a series one after the other with abutting short edges 8*a*, 8*b* such that they form together a spiral that runs through the drum and that is essentially a continuous screw.

Since the two mounting fixtures 9, 9' of the spiral module are identical, only one of these will be described below for the sake of simplicity.

The mounting fixture 9 of the spiral module 1 is joined in a manner that allows it to be removed through first attachment means 10 to the lower edge 6*b* of the part 5 that transports the ore. The said first attachment means 10 allows the mounting fixture 9 to be set into different angular positions relative to the longitudinal axis of the part that transport the ore through its rotation around an axis C that is perpendicular to the longitudinal axis of the part 5 that transports ore. The different angles of the mounting fixture 9 are denoted "D" in FIG. 3. When the spiral module 1 is in its mounted position, the axis C in practice forms a normal to the sieving deck 2. After each mounting fixture 9 has been set, it can be locked in the desired position to the part 5 that transports ore with the aid of the first attachment means 10.

Figure 5:
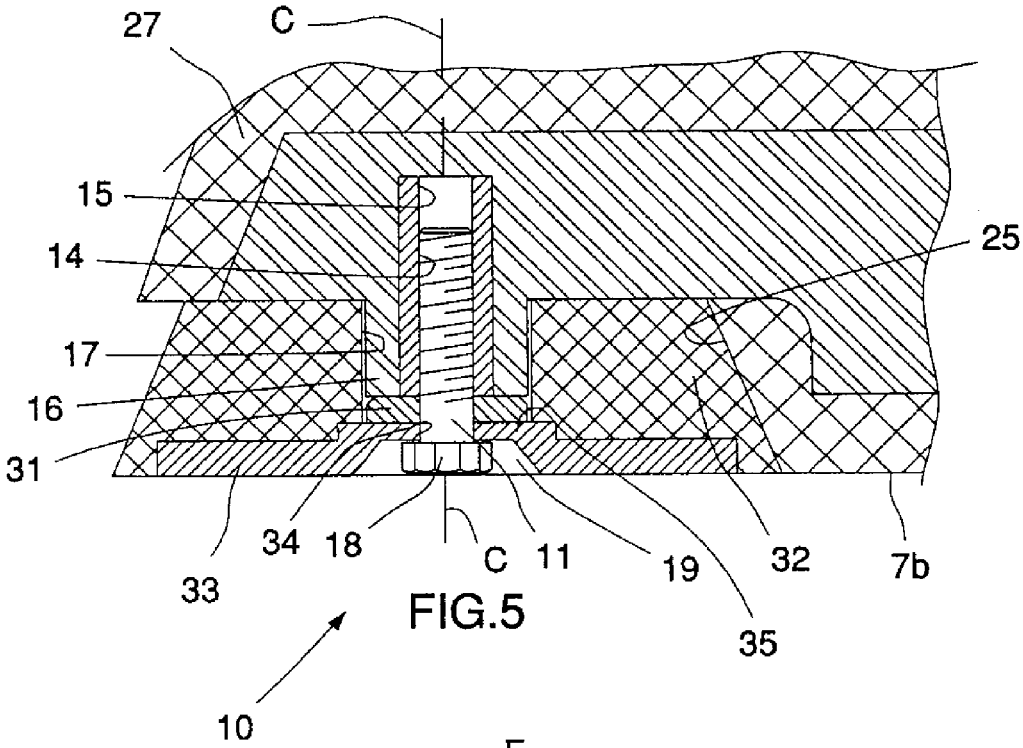
FIG. 5 shows a cross-section along the line V-V in FIG. 2

With reference also to FIG. 5, the first attachment means 10 comprises a screw 11 that passes through a hole 12 in the mounting fixture 9 and interacts with a thread 14 arranged in the lower edge of the part 5 that transports ore. The said thread 14 is located in a bottom hole 15 in the part 5 that transports ore. The bottom hole 15 is arranged as a part 16 that has the form of a peg that protrudes from the lower edge 7*b* of the part 5 that transports ore and fits into a correspondingly designed hole 17 with the form of a terrace in the upper surface 9*a* of the mounting fixture 9, whereby the mounting of the mounting fixture 9 onto the part that transports ore takes place through interaction between the said peg 16 and the hole 17.

The head 18 of the screw is discretely located in a recess 19 arranged in the hole 17 with the form of a terrace located in the mounting fixture 9. The said recess 19 is located in the bottom surface 9*b* of the mounting fixture 9 whereby the head 18 of the screw faces towards the sieving deck 2 when the spiral element 1 is mounted. The recess 19 is so designed that a tool for turning the screw 11 can interact with the head of the screw also when the head of the screw is located in the recess. Due to the fact that the head 18 of the screw faces towards the sieving deck 2 and the head is located within the recess 19, it is protected from contact with the charge when the spiral module 1 is mounted.

The spiral module 1 comprises further a second attachment means 20 intended to attach the spiral module onto the sieving deck 2 in a manner that allows it to be removed, whereby the broader bottom side 9*b* of the mounting fixture 9 is intended to be mounted in contact with the sieving deck 2.

Figure 6:
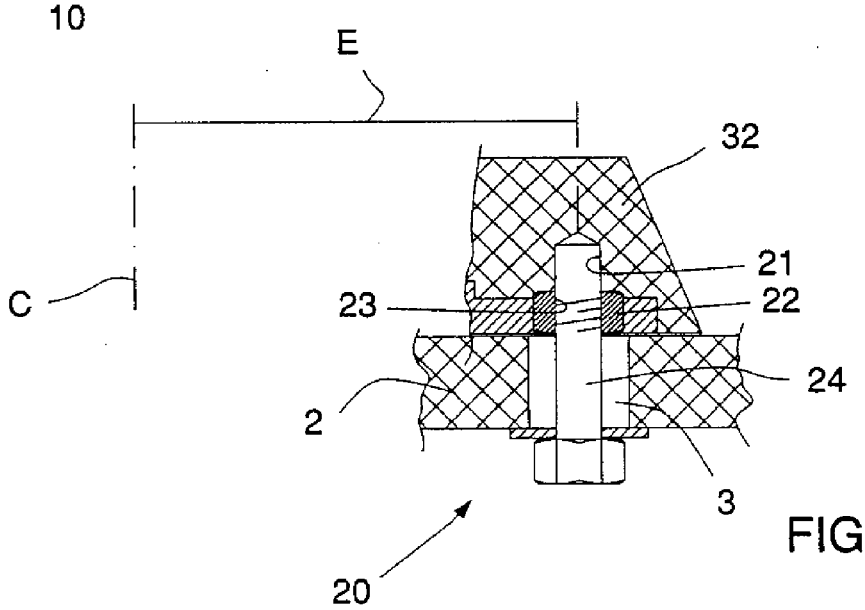
FIG. 6 shows a cross-section along the line VI-VI in FIG. 2.

With reference also to FIG. 6, this second attachment means 20 comprises a thread 23 that is located at a radial distance E from the axis of rotation C of the mounting fixture 9 and that is arranged in a bottom hole 21 in the bottom side 9*b* of the mounting fixture 9 through a nut 22 welded in place, and which bottom hole has an inlet opening that faces towards the sieving deck 2 when the spiral element 1 is mounted.

As is shown in FIGS. 2 and 6, the thread 23 that is arranged in the mounting fixture 9 is intended for interaction with a screw 24 that is arranged to pass through any one of the openings 3 of the sieving deck 2, as in shown in FIGS. 1 and 3, for fixing the spiral element 1. Through rotation of the mounting fixture 9 around the axis C and relative to the part 5 that transports ore, a suitable sieving opening 3 in the sieving deck 2 is placed in position, after which the spiral module 1 is fixed onto the sieving deck 2 with the aid of the screw 24 that is screwed into the thread 23 of the mounting fixture after it has passed through any one of the said sieving openings 3.

In order to prevent it being possible for the charge to pass under the spiral module 1 that has been mounted against the sieving deck 2, the lower edge 7*b* of the part 5 that transports ore is provided with grooves 25 into which the mounting fixtures 9, 9' are so inserted that the parts follow a common line and are essentially in continuous contact with the sieving deck 2. This is seen most clearly in FIGS. 1 and 5.

Figure 4:
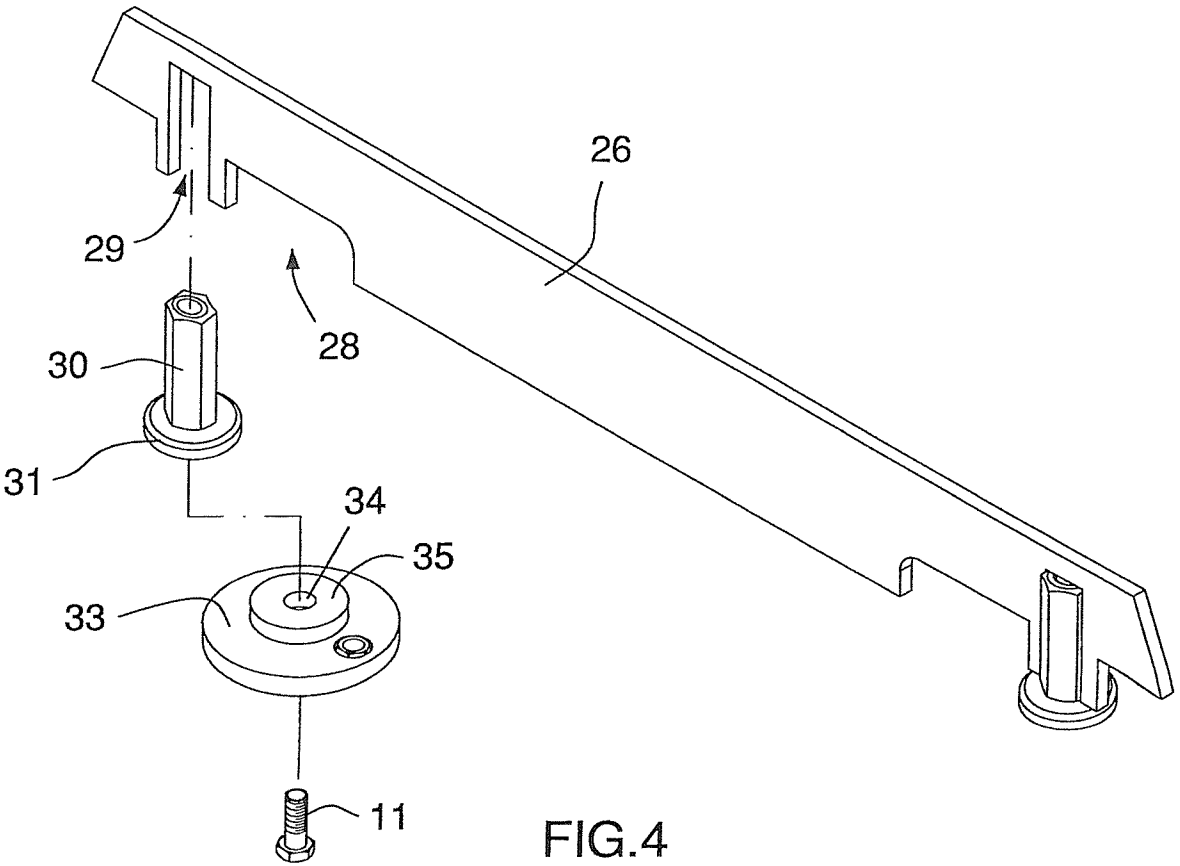
FIG. 4 shows a perspective view obliquely from above of the internal reinforcement of the spiral module with parts that have been partially separated from each other

The inner reinforcement of the spiral module 1 is shown in more detail in FIGS. 4 and 5, and, as these drawings make clear, the part 5 of the spiral module that transports ore is formed as a pre-fabricated unit of figure-cut sheet metal, as an extended flat-shaped rod 26 provided with an elastic covering 27 that functions as wear lining. The inner reinforcement 26, with the form of a flat rod, of the part 5 that transports ore is provided with first and second indentations, 28 and 29 respectively, of which the first indentation 28 forms part of the above-mentioned groove 25, while the second indentation 29 forms a seating into which a nut 30 has been welded. As FIG. 4 makes clear, the said nut 30 forms the thread 14 of the part 5 that transports ore. The nut 30 consists of an extended hexagonal nut with an internal thread, one end of which is provided with a circular flange 31 that is somewhat broader than the nut otherwise.

The mounting fixture 9 of the spiral module 1 is designed as a product that is to wear, in the form of a pre-fabricated unit provided with an elastic cover 32 that functions as a wear lining, and it demonstrates an inner reinforcement that consists of a flat ring-shaped washer 33 with a central hole 34 that forms part of the hole 17 of the mounting fixture 9, which hole has a larger diameter as described above. A flat elevated part 35 is present at the centre of the washer 33, with a diameter that is less than the diameter of the washer and that essentially corresponds to the flange 31, and in this way it protrudes from the lower edge 6*b* of the part that transports ore with the extent of the part 16 that is similar to a peg as is shown in FIG. 2. More detailed study of FIG. 5 should allow it to be understood that the through hole 17, 34 has the form of a step and that the elevated part 35 of the washer 33 defines a plane that is recessed into the hole with the form of a step. This plane thus forms part of the upper surface 9*a* of the mounting fixture 9 while the lower surface of the washer 33 forms a major part of the lower surface 9*b* of the mounting fixture 9. As also is seen most clearly in FIG. 5, the flange 31 of the nut 30 with a hexagonal shape makes supportive contact with the flat elevated part 35 of the washer 33, while at the same time the lower surface of the washer forms a metallic free surface that makes contact with the sieving deck 2 and that is protected from contact with the charge through its cladding. It should be realised, as has been described above, that a very stable power-transfer connection between the part 5 that transports ore and the mounting fixture 9 is obtained since the part that transports ore and the mounting fixture are in metallic contact with each other through their inner reinforcements 26, 30, 31 and 35, respectively. The ability of the spiral module 1 to absorb force is further reinforced through the metal washer 33 that forms the principal part of the bottom surface 9*b* of the mounting fixture 9 that faces the sieving deck 2.

The spiral module 1 is used in the following manner:

With a freed first attachment means 10, i.e. after the screw 11 has been released, openings 3 in the sieving deck 2 that are suitable for mounting the spiral module 1 are positioned to different angular positions E through rotation of the mounting fixture 9 around the axis C. The mounting fixture is subsequently fixed with the aid of the first attachment means, i.e. the attachment means is fixed at the set position by engagement of the screw 11 with the thread 14.

The second mounting fixture 9' of the spiral module 1 is adjusted in the same manner as has been described above.

The spiral module 1 that has been adjusted in the manner described is fixed to the sieving deck 2 with the aid of a second attachment means 20. Thus, the spiral module is attached through the screw 24, after it has been inserted through the positioned sieving opening 3 in the sieving deck 2, being screwed in from the outer surface of the sieving deck into the thread 23 of the mounting fixture 9. The spiral module 1 is fixed in place through engagement of the screw 24 with the thread 23.

The second mounting fixture 9' of the spiral module 1 is fixed to the sieving deck 2 in the same manner as has been described above.

The present spiral module is not limited to what has been described above: it can be changed and modified in a number of different ways within the scope of the innovative concept specified by the attached patent claims. It should be understood in this part that neither the flat part that transports ore nor the two mounting fixtures need to be manufactured as products designed for wear: they can be manufactured from any suitable wear-resistant material.

The invention claimed is:

1. A spiral module (1) for mounting one after another to form a spiral or screw guide along a concave inner surface of a perforated sieving deck (2) of a trommel screen to transport a charge forward through the trommel screen, the spiral module comprising:

an extended flat part (5) that contacts and transports the charge along the sieving deck of the trommel screen:

first and second mounting fittings (9, 9') connected to the extended flat part for coupling the spiral module with hole openings (3) formed in the sieving deck, wherein the extended flat part (5) includes two principal surfaces (6*a*, 6*b*) that face away from each other, two long edges (7*a*, 7*b*) and two short edges (8*a*, 8*b*), wherein the first and second mounting fittings (9, 9') mount the spiral module standing onto the inner surface of the sieving deck such that the flat part (5) extends toward a center of the trommel screen where one (7*a*) of the two long edges faces the center of the trommel screen and the other long edge (7*b*) faces the sieving deck of the trommel screen, wherein in order to facilitate removal and adjustability of the spiral module, the spiral module further comprises:

a first attachment means (10) that connects each of the first and second mounting fittings (9, 9') to the flat part and enables rotatable adjustment and locking of the first and second mounting fittings (9, 9') into different angular positions relative to a longitudinal axis of the extended flat part (5), wherein each of the first and second mounting fittings (9, 9') are rotatable about an axis of rotation (C) that is perpendicular to sieving deck when the spiral module is mounted to the sieving deck; and a second attachment means (20) supported by each of the first and second mounting fittings (9, 9') to face towards the sieving deck and located at a radial distance (E) from the axis of rotation (C) of the first and second mounting fittings, wherein each of the first and second mounting fittings are rotatable about the axis of rotation to position the second attachment means at different angular positions relative to the longitudinal axis of the extended flat part, thereby allowing the second attachment means to be selectively connected with the hole openings in the sieving deck.

2. The spiral module according to claim 1, whereby the first attachment means (10) can be adjusted between a locking position in which the mounting fitting (9, 9') is fixed to the flat part (5) that transports ore, and an open position in which the mounting fitting can be adjusted or fully removed from the flat part that transports ore.

3. The spiral module according to claim 1, whereby the axis (C) of rotation is perpendicular to the longitudinal axis of the flat part (5) that transports ore.

4. The spiral module according to claim 1, whereby the flat part (5) that transports ore is designed as a pre-fabricated product designed to wear consisting of a metal frame lined by an elastic cladding (27) that functions as wear lining.

5. The spiral module according to claim 1, whereby each mounting fitting (9, 9') is designed as a pre-fabricated product designed to wear consisting of a metal frame lined by an elastic cladding (32) that functions as wear lining.

6. The spiral module according to claim 5, whereby the flat part (5) that transports ore and the first and second mounting fittings (9, 9') have contact surfaces that face each other and that demonstrate the absence of wear protection in at least some areas.

7. The spiral module according to claim 1, whereby the first attachment means (10) comprises a screw (11) that passes through a central hole (12) in each of the first and second mounting fittings (9) and interacts with a thread (14) arranged in the part (5) that transports ore.

8. The spiral module according to claim 7, whereby a head (18) of the screw (11) is discretely inserted into a recess (19) arranged in the central hole (12) of the mounting fitting (9), which recess faces towards the sieving deck (2) when the spiral module is in a mounted position.

9. The spiral module according to claim 7, whereby the thread (14) is arranged in a peg (16) that protrudes from the flat part that transports ore and fits into a hole (17) with a corresponding design in the mounting fitting (9), with which hole the mounting fixture is brought into contact with the flat part that transports ore through interaction between the said peg and hole.

10. The spiral module according to claim 1, whereby each of the first and second mounting fittings (9, 9') has the form of a truncated circular cone with an upper surface (9*a*) and a lower surface (9*b*) arranged at a distance from each other in parallel planes and which mounting fitting forms a foot that supports the part (5) that transports ore on the sieving deck.

11. The spiral module according to claim 1, whereby the flat part (5) that transports ore is provided with grooves (25) into which the mounting fixtures (9, 9') are so inserted that the said parts follow a common line in connection with the sieving deck (2).

12. The spiral module according to claim 1, whereby the second attachment means (20) comprises a thread (23) formed in the mounting fitting and intended to interact with a mounting screw (24) that runs through a one of the openings (3) in the sieving deck (2).

* * * * *